US008083544B2

(12) United States Patent
Chee

(10) Patent No.: US 8,083,544 B2
(45) Date of Patent: Dec. 27, 2011

(54) COAXIAL CONNECTOR WITH RESILIENT PIN FOR PROVIDING CONTINUED RELIABLE CONTACT

(75) Inventor: Alexander B. Chee, Marietta, GA (US)

(73) Assignee: Pro Brand International, Inc., Marietta, GA (US)

( * ) Notice: Subject to any disclaimer, the term of this patent is extended or adjusted under 35 U.S.C. 154(b) by 0 days.

(21) Appl. No.: 12/861,859

(22) Filed: Aug. 24, 2010

(65) Prior Publication Data

US 2011/0045694 A1 Feb. 24, 2011

Related U.S. Application Data

(60) Provisional application No. 61/236,203, filed on Aug. 24, 2009.

(51) Int. Cl.
*H01R 9/05* (2006.01)

(52) U.S. Cl. ..... 439/578; 439/582; 439/851

(58) Field of Classification Search ..... 439/578, 439/582, 851, 339, 583, 638
See application file for complete search history.

(56) References Cited

U.S. PATENT DOCUMENTS

| | | | | |
|---|---|---|---|---|
| 5,498,175 | A * | 3/1996 | Yeh et al. | 439/578 |
| 5,667,409 | A * | 9/1997 | Wong et al. | 439/654 |
| 5,863,226 | A * | 1/1999 | Lan et al. | 439/852 |
| 5,865,654 | A * | 2/1999 | Shimirak et al. | 439/852 |
| 6,113,431 | A * | 9/2000 | Wong | 439/638 |
| 6,227,868 | B1 * | 5/2001 | Wlodarski | 439/63 |
| 6,276,970 | B1 * | 8/2001 | Wong | 439/638 |
| 6,595,799 | B2 * | 7/2003 | Yao | 439/578 |
| 6,808,426 | B2 * | 10/2004 | Liu | 439/654 |
| 6,899,563 | B1 * | 5/2005 | Lee | 439/578 |
| 7,052,283 | B2 * | 5/2006 | Pixley et al. | 439/620.03 |
| 7,824,216 | B2 * | 11/2010 | Purdy | 439/578 |
| 7,931,509 | B2 * | 4/2011 | Shaw et al. | 439/851 |

* cited by examiner

*Primary Examiner* — Hae Moon Hyeon
(74) *Attorney, Agent, or Firm* — Womble Carlyle Sandridge & Rice, LLP

(57) ABSTRACT

A connector for use in attaching a coaxial cable includes a conducting body having a pair of insulators mounted at the ends of the conducting body. The insulators support the ends of a center pin formed from a conducting material. The ends of the center pin can include contact structures having pairs of front and back contact leaves defining pin-shaped connectors that each provide an area of increased surface contact with a center conducting wire of the coaxial cable to enable larger and more consistent current flows and enhanced radio frequency return loss for the connector.

13 Claims, 10 Drawing Sheets

COAXIAL CONNECTOR WITH RESILIENT PIN FOR PROVIDING CONTINUED RELIABLE CONTACT

CROSS-REFERENCE TO RELATED APPLICATIONS

This application claims the benefit of U.S. Provisional Patent Application No. 61/236,203, filed Aug. 24, 2009.

INCORPORATION BY REFERENCE

U.S. Provisional Application No. 61/236,203, which was filed on Aug. 24, 2009, is hereby incorporated by reference for all purposes as if presented herein in its entirety.

FIELD OF THE INVENTION

The present invention is directed to coaxial connectors and in particular to a coaxial connector with a resilient pin structure that provides continued reliable contact over time and provides for reusability of the connector.

BACKGROUND OF THE INVENTION

In cable signal transmission networks, such as standard cable television (TV) systems, closed-circuit TV or video monitoring systems, as well as in satellite TV systems, a coaxial cable generally is required to transmit signals from a receiver or dish/antenna to a monitor such as a television or video monitor. As such TV systems have developed, consumers desire and are demanding increasingly higher quality TV reception, especially with newer high definition programming, and the quality of the coaxial cable connector between the input co-axial cable and the receiver and/or TV directly affects the quality of TV reception. In addition, bundling or combining of both cable TV and telephone is becoming increasingly more common, and thus, the central signal transmission wires of the cable now often needs to bear a larger current because the cable needs to receive input signals for TV (such as TV program selection and TV shopping item selection) as well as potentially provide the current for the phone. Also, due to fast growing demand of network bandwidths, frequencies of television signals transmitted by coaxial cables also are approaching higher frequencies as technology necessarily advances. However, as frequencies of signals transmitted get higher, quality of connectors for accessing coaxial cables in transmission paths needs to be increased as well. If slight or poor connectivity exists between the contact points of the connectors and the cable wire, signals being transmitted can be lost somewhere along the path, potentially resulting in loss of important data and poor picture quality.

Typically, as illustrated in FIG. 1, the inner structure of a conventional type coaxial cable connector "A" typically will have pairs of flat contact springs "B" within an insulating sleeve "C", and when the generally cylindrical central wire of the cable is inserted into the connector, the connector structure typically only has two points (i.e., top and bottom) of contact often leading to inefficient transmission/electrical contact and signal or power loss. Additionally, other types of connectors have been developed with an inner structure wherein additional supports, such as plastic fingers or other, similar biasing members are provided for supporting and assisting in biasing the contacts of the connector against the contact wire or center conductor of the co-axial cable to help maintain contact therebetween. However, over time, as such co-axial connectors are subjected to repeated uses, i.e., where they are disconnected and re-connected multiple times to connect a co-axial cable to different receivers or components, and/or over time and exposure to fluctuations in temperature and/or humidity, the biasing contact provided by the spring contacts and the resilient plastic fingers can weaken. As the resiliency of the contacts is weakened, the retention force provided thereby is weakened, which can lead to a corresponding increased loss in signal strength. To counter the loss of resilience, some connectors have used thicker or stronger materials for the contacts, which correspondingly has increased costs of such connectors, and degrades in return loss as the contacts or pins of the connectors have been increased in size.

Accordingly, it can be seen that a need exists for a connector for use in connecting coaxial cables, wires or other electrical or data transmission lines that addresses the foregoing and other related and unrelated problems in the art.

SUMMARY OF THE INVENTION

Briefly described, the present invention generally relates to a coupling connector for connecting or coupling the ends of cables, such as coaxial cables, wires or other electrical data or video transmission cables or lines or for connecting such data or video transmission lines or cables to a receiver, printed circuit board or other similar electrical component. In one example embodiment, the coupling connector generally includes a connector or conducting body having open first and second ends and generally defining an inner chamber or passage therebetween.

A center pin or conductor is received within the inner chamber of the connector body and generally is formed from a conductive material to facilitate transmission of electrical signals through the connector. The center pin can be of a reduced size or diameter, i.e., as small as 2.0 mm (or less) and can be formed from a rolled blank, die cut, or otherwise formed, with at least one contact structure at one end thereof. The contact structure generally will comprise at least one pair of lipped upper and lower contacts that are resiliently biased toward each other for engaging a conductor wire of coaxial or other electrical or data transmission cable or line. The lipped contacts of the contact structure generally include a back or first, downwardly tapered or slanted portion or leaf, and a front or second, outwardly flaring, angled portion or leaf extending upwardly and outwardly from the first leaf at an intersection or joint therebetween. A notch, slit or other cutout generally can be formed in each of the upper and lower contacts along the intersection point or joint between the first and second leaves thereof, so as to define a pin-shaped connector in which the conductor wire or pin of the electrical or data transmission cable can be received. The upper and lower contacts generally will be formed with an inherent resilience or bias so as to engage the conductor wire in a tight, biased fit to ensure tight, stable contact between the upper and lower leaves of the contact structure and the conductor wire of the cable.

Additionally, the end(s) of the center pin at which the at least one contact structure is formed can include lateral side portions separated from and extending along the sides of the first and second leaves. The side portions can be resiliently biased inwardly so as to at least partially engage and help support or maintain the contact leaves in their biased engagement with the conductor wire of the cable. In one embodiment of the present invention, the center pin can be provided with a contact structure at each of its opposite ends. In another embodiment, the center pin can be formed with a first body portion that is provided with a contact structure at one end thereof, and at its opposite end, a second body portion can be provided with an elongated conductor wire or pin extending in an opposite direction from the contact structure and projecting from an open one of the first or second ends of the connector body for connection or engagement with a receiver or printed circuit board. In such additional embodiment, the two body portions of the center pin can be formed separately and attached together such as by welding or by a frictional engagement or fit between the two body portions.

A pin support structure further will be provided within the connector body for supporting the center pin in a rigid, approximately centered alignment, with the ends of the center pin aligned with the open first and second ends of the connector body. The pin support structure generally will include a first insulator that is adapted to receive a first end of the center pin, and a second insulator adapted to fit about and support a second end of the center pin. Each insulator generally is formed from a dielectric or other insulating or non-conductive material and generally has a front part having an enlarged diameter and a center hole or opening therethrough, and a tube or sleeve portion projecting inwardly from the front part. In one embodiment, each of the insulators will be adapted to receive a contact structure therein, with the contact leaves of the contact structure being substantially encapsulated and engaged within the tube. As a result, the contacts are maintained in a position biased toward one another so as to help enhance and support continued resilience of the contacts over repeated uses and time. The side portions of the center pin adjacent the contact structures further can be contained or urged slightly inwardly by the tube of their insulators to provide additional support and rigidity and to maintain resilience of the contacts when engaged with the conductor wire of the cable.

In an alternative embodiment, wherein the center pin includes an elongated conductor pin or wire, the tube of a first insulator can be formed with a first diameter and the tube of the second insulator formed with a second, larger diameter. The conductor pin can be received through the center opening of the first insulator, while the second end of the center pin, at which a contact structure can be formed, will be at least partially received within the tube of the first insulator, with the tube of the first insulator, and thus the contact structure, further being telescopically received within the tube of the second insulator. A sealing ring and/or one or more washers also can be placed about the conductive pin or wire and/or in front of the front ends of the insulators to help seal the ends of the connector body with the center pin being supported therein.

Various objects, features and advantages of the present invention will become apparent to those skilled in the art upon reading the following detailed description, when taken in conjunction with the accompanying drawings.

DETAILED DESCRIPTION OF THE INVENTION

Figure 1:
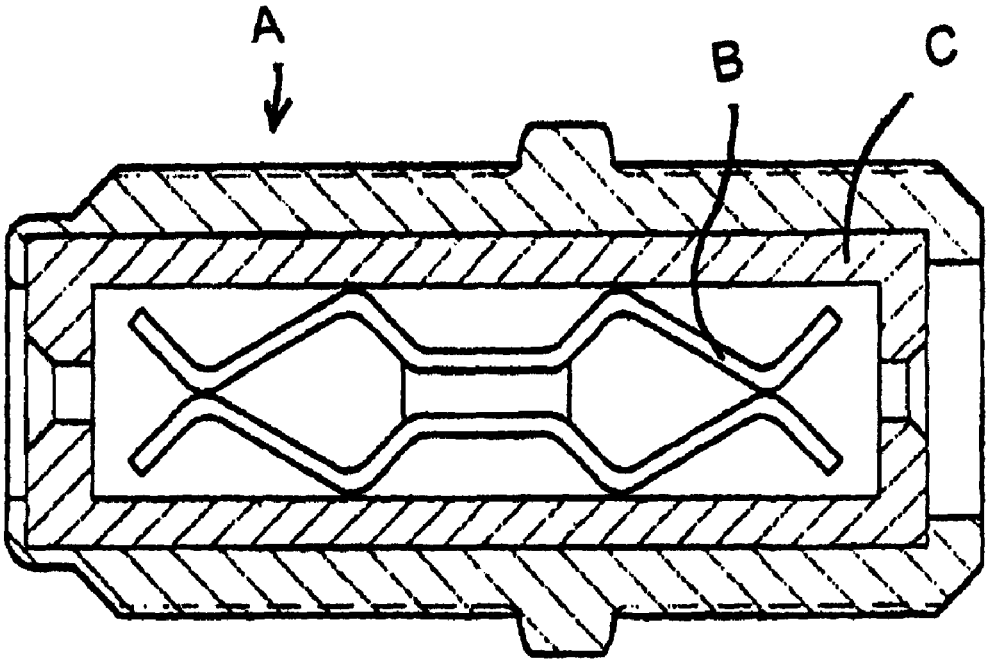
FIG. 1 (Prior Art)
FIG. 1 is a side cross-sectional view of a prior art coupling connector.
Figure 2:
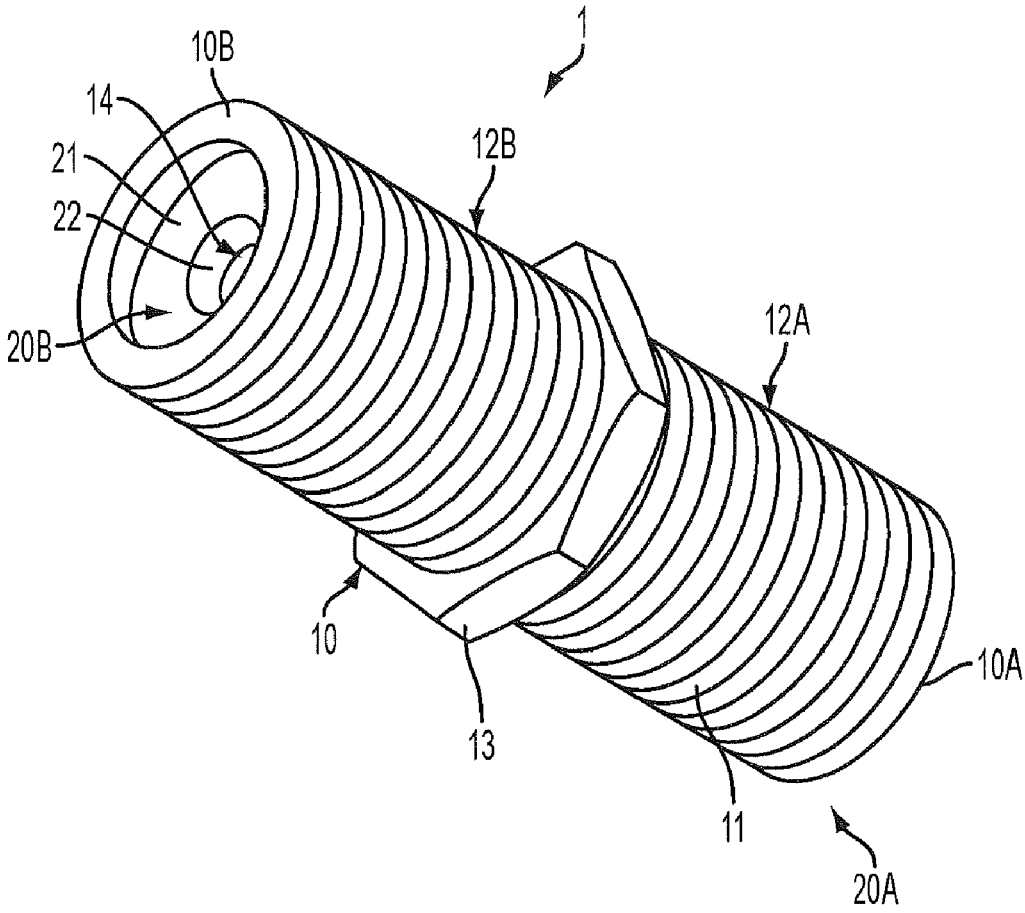
FIG. 2 is a perspective view of one embodiment of a coupling connector according to the principles of the present invention.

Referring now to the drawing figures, in which like numerals indicate like parts throughout the several views, FIGS. 2-8 generally illustrate one embodiment of a coupling connector 1 generally for connecting or coupling the ends of cables, such as coaxial cables, wires or other types of electrical data or video transmission lines or cables. FIG. 2 presents one example embodiment of the coupling connector 1 according to the principles of the present invention. A female coupling coaxial connector is presented here as an example of this invention; however, it will be understood by those skilled in the art, that application of the invention is not limited solely to a coupling female connector, but rather can be used with various types of connectors and cable connection systems.

Figure 3:
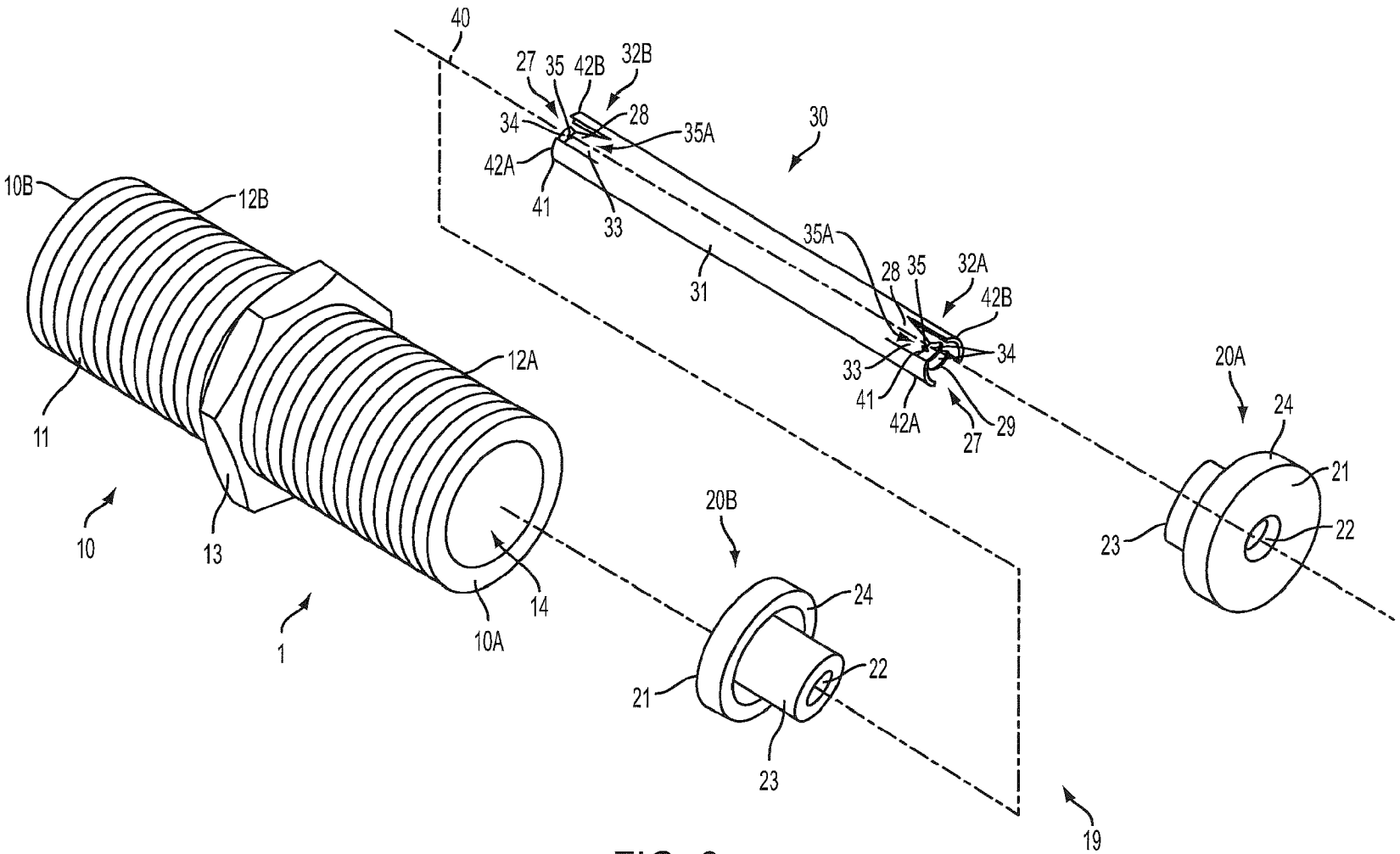
FIG. 3 is an exploded perspective view of the coupling connector of FIG. 2.

As shown in FIGS. 2-3, the connector generally comprises a connector or conducting body 10, with first and second insulators 20A/20B generally received in a friction fitting or other fixed engagement within each end 10A/10B of the body 10, which insulators engage and support the ends 32A/32B (FIG. 3) of a conductive center connector pin 30 (FIG. 3) within the conducting body. In the embodiment shown in FIGS. 2-3, the conducting body 10 is formed from a rigid, durable material such as a metal and is shown as constructed with threads 11 formed along its outside body or outer side surface. A pair of tubular body sections 12A/12B is defined along the conducting body, with a hex nut 13 in the middle or near to the middle of the conducting body sections 12A/12B, and an inner chamber or control passage 14 defined through the conducting body 10, between the ends 10A/10B thereof. The threads 11 help provide mating connections with other cable connectors and/or the output/input jacks for transmitters, receivers and monitors or other, similar cable or transmission line connections. It will also be understood that only one body section 12A/12B can be threaded, and/or that other types of connections also can be used for connection of the connector 1 to a coaxial cable 200 (FIGS. 6-7) if needed or desired. As further shown in FIG. 7, pre-formed end blocks 16 and 17, which can be sealed end blocks, also can be fitted into the conducting body 10, after the center conductor pin 30 and the insulators 20A/20B are inserted into the conducting body 10 (FIG. 3 and FIG. 7) to enclose and/or seal the ends 10A/10B of the conducting body and thus the center pin therein.

As FIG. 3 indicates, the insulators 20A/20B function as a pin support structure 19 for supporting the ends 32A/32B or portions of the center connector pin 30. Each insulator 20A/

Figure 6:
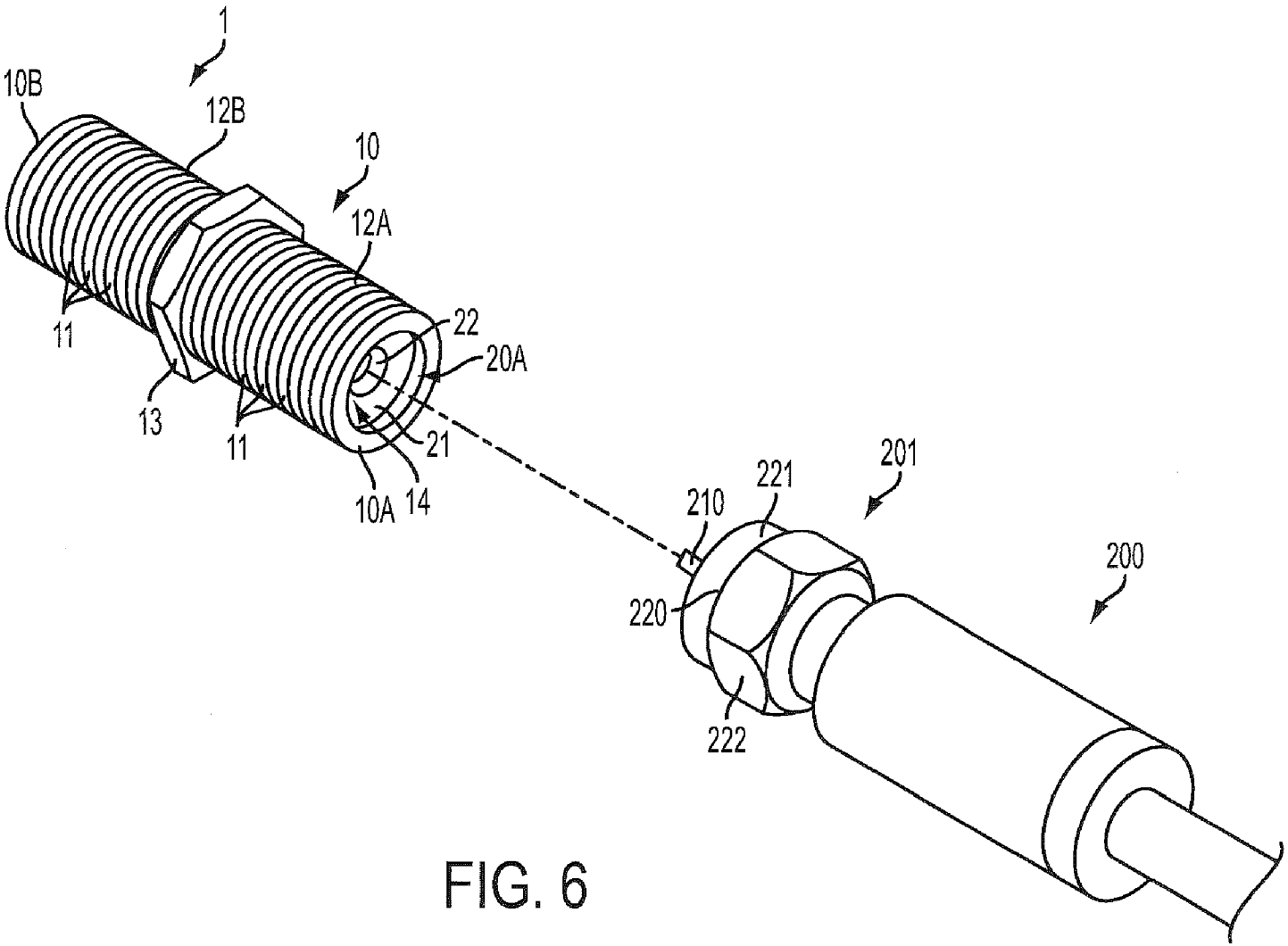
FIG. 6 is a perspective illustration showing the connection of the coupling connector to a cable or transmission line.
Figure 7:
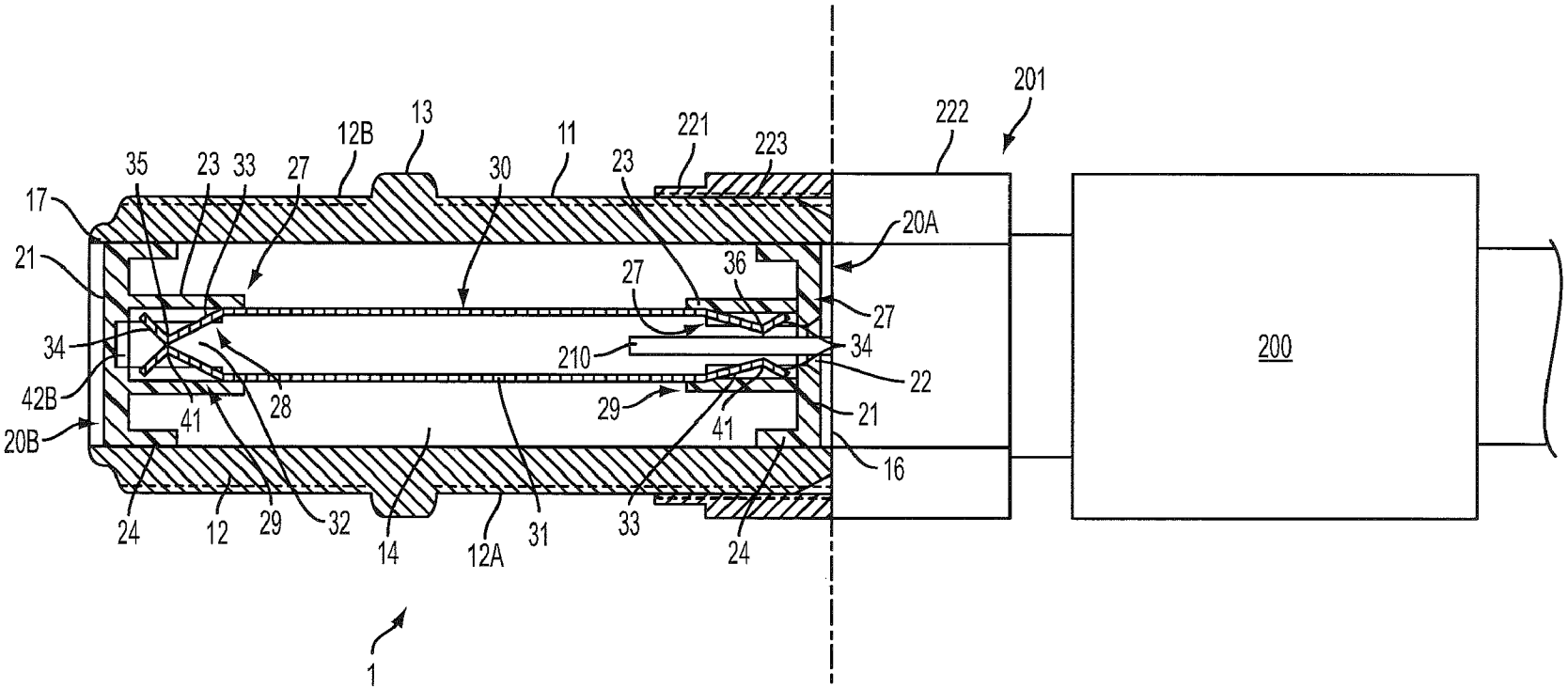
FIG. 7 is a side elevational view, taken in partial cross-section, of one embodiment of the coupling connector attached to a cable or transmission line.

20B has a generally cylindrical structure, with a front part 21, a center hole or passage 22, a inner tube or sleeve portion 23 projecting toward the center of the conducting body 10, and with the front part 21 having an enlarged diameter so as to define an outer ring 24 (FIG. 3 and FIG. 7). The insulators 20A/20B generally are formed from a rigid, durable dielectric or similar insulating or non-conductive material, such as a plastic material, and support the opposite ends 32A/32B of the center pin 30 so as to maintain the center pin 30 in a substantially centered, non-contacting alignment within the conducting body to prevent inadvertent signal loss or diminishment. The insulators are further configured to minimize the amount of material required to provide sufficient support to the ends 32A/32B of the center pin 30. As indicated in FIG. 7, the outer ring 24 formed about each insulator's front part 21 engages the inner chamber wall of the conducting body, with the inner tubes 23 of the insulators receiving and substantially encompassing or containing the ends of the center pin 30 for supporting the ends 32A/32B in a stable, centered position, while further enabling the contacts 28/29 formed at the ends 32A/32B of the center pin 30 to flex or move slightly as needed to facilitate entry and/or receipt of the conductive wire of a cable to help ensure an efficient stable connection between the connector 1 and the cable 200 (FIG. 6).

Figure 4:
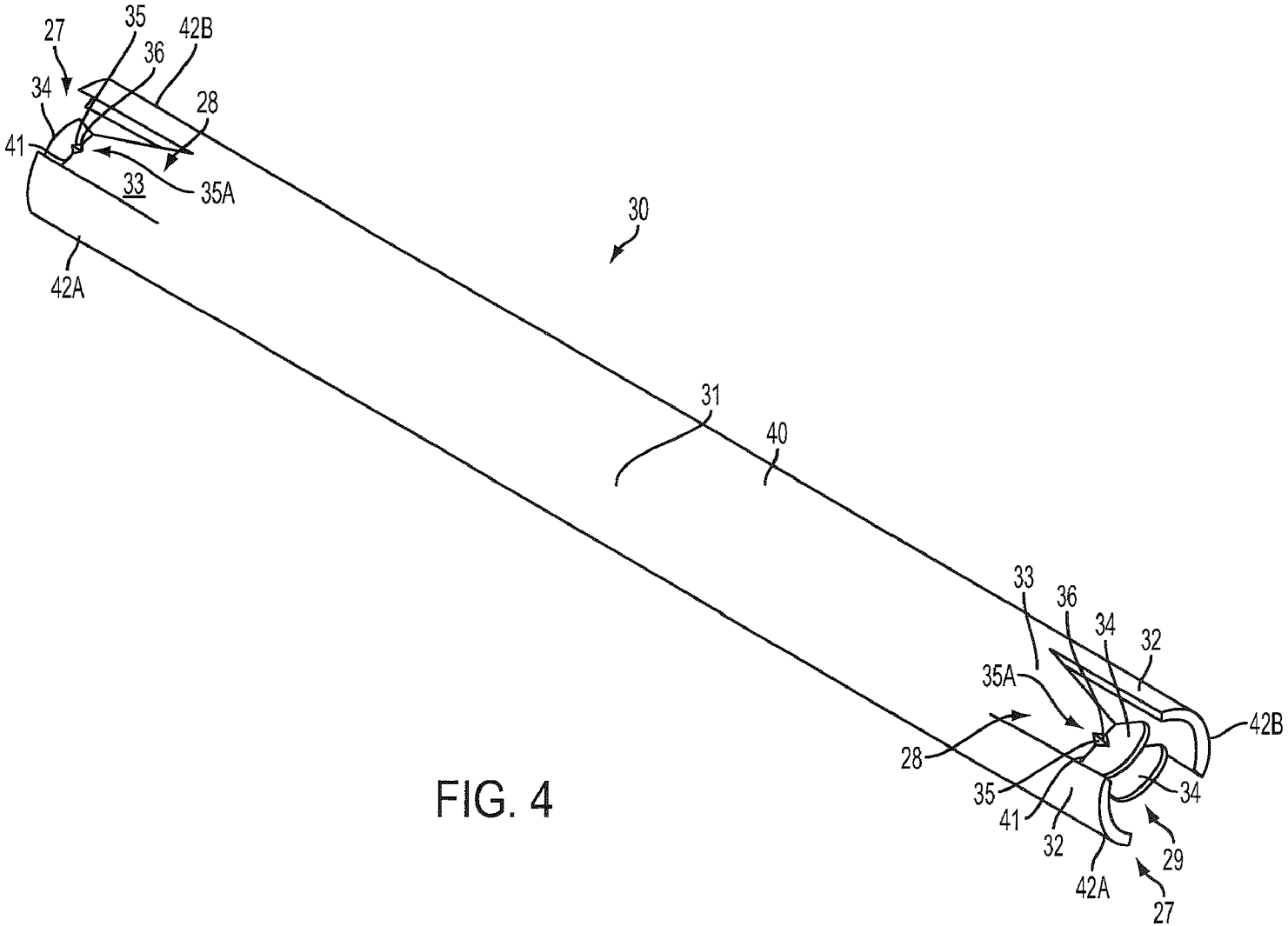
FIG. 4 is a perspective view of one embodiment of a center pin for a coupling connector according to the principles of the present invention.
Figure 5A:
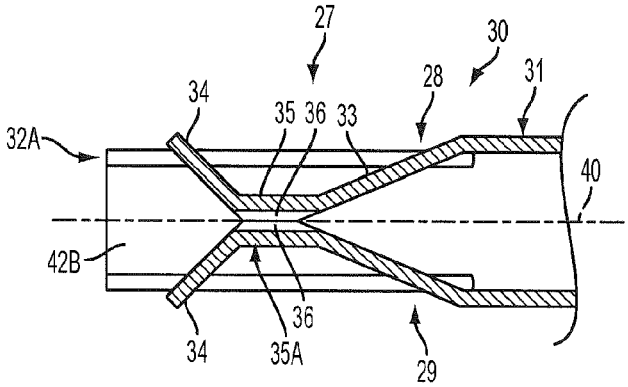
FIG. 5A is a side view, taken in partial cross-section, of one of the contact structures of the center pin of FIG. 4.
Figure 5B:
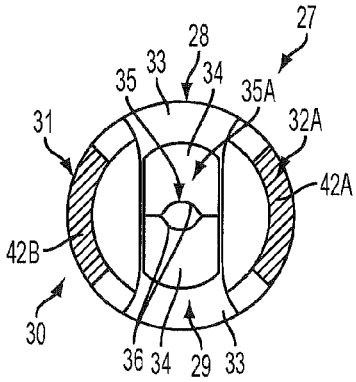
FIG. 5B is an end view, taken in partial cross-section, of a contact structure of the center pin of FIG. 4.

As indicated in FIG. 3, the center pin 30 is held within the insulators 20A/20B, and extends longitudinally between the insulators, being spaced from the inner wall of the conducting body 10. The center pin 30 (FIG. 4) has an elongated tubular conductive body 31 generally formed from a resilient, conductive metal material such as copper or other, similar transmissive or conductor material. The conductive body 31 can be stamped, rolled or otherwise formed, and in the present embodiment will include a contact structure 27 at each of its opposite ends 32A and 32B (FIG. 4). The contact structures 27 each generally include lipped upper and lower pairs of contacts 28/29, each of which consists of a first or back contact leaf 33, a second or front contact leaf 34, and a notch 35A formed in each contact leaf and defining a pin-shaped contactor 35 having a contact surface 36 formed therebetween as indicated in FIGS. 4, 5A and 7. FIGS. 5A and 5B provide a side cross-sectional view and an end view, respectively, of one of the ends 32A of the center pin 30. The first or back contact leaf 33 of each of the contacts generally extends forwardly and downwardly toward a center line 40 of the conducting body 31, terminating at a junction or joint 41 whereupon the second or front contact leaf 34 projects upwardly and forwardly therefrom. The upper and front contacts 28/29 are biased toward each other by the natural resilience of the metal material of the conductive center pin body and the inwardly sloped orientations of the back contact leaves 33.

As indicated in FIGS. 4, 5A, notches or other cut-out portions forming the pin-shaped contactors 35 are defined along the junctions between the pairs of front and back contact leaves 34, 33, and, as shown in FIG. 5B, can have a substantially curved, semi-cylindrical, U-shaped or V-shaped configuration, or other, similar structure or shape. As a result, a contact seat or area of increased contact surface 36 is provided between the front and back contact leaves of the center pin and the center conductor wire of a coaxial cable. This area of increased contact surface and the inwardly directed biasing or resilient force applied by the contacts helps provide a strong, consistent connection to the center conductor wire of the coaxial cable or transmission line to help minimize potential signal loss in the connection between the coaxial cable and the coupling 1 (FIG. 6) of the present invention.

In addition, as illustrated in FIG. 4, the ends 32A/32B of the center pin 30 further can include lateral side portions 42A/42B. These lateral side portions 42A/42B are separated from the upper and lower contacts of the contact structures and generally are shown with curved or substantially arcuate configurations. When the ends 32A/32B of the center pin 30 are received within the tubes 23 of their associated supporting insulator 20A/20B, the side portions 42A/42B can be urged inwardly, in addition to being inherently resiliently biased inwardly, so as to provide further support and biasing force to urge and help maintain the upper and lower contacts 28/29 of the contact structures in tight engagement with the conductive wire of a cable to provide enhanced retention force, especially over time and repeated use, to the connector.

FIGS. 6-7 illustrate one embodiment of the usage of the present embodiment of the coupling connector 1. As indicated in FIG. 6, in this example/embodiment, a female coupling connector 1 is shown in use for coupling two male connectors 201 of a pair of coaxial cables 200 together in series. FIG. 7 shows a cross-sectional view of the female connector 1 of this invention installed with a male coaxial connector 201. When the center conductor wire 210 enters the female connector 1, both the back contact leaf pair 33 and front contact leaf pair 34 separate and/or move outwardly to receive the center conductor wire 210 within the pin-shaped contactor defined by the notches formed in the contact leaves. After the center conductor wire 210 enters the female connector 1, the female connector pin-shaped contactors 35 engage and form an extended surface contact with and along a portion of the center conductor wire 210, as indicated in FIG. 7.

As also indicated in FIGS. 5A, 6 and 7, in the present embodiment the front contact leaves 34 have been constructed and arranged in such way that the front contact leaves 34 bear against and are restrained or otherwise maintained in inwardly urged or biased positions by the inner surface of inner tube 23 of a corresponding insulator 20A or 20B after the center conductor wire 210 is installed between the contacts. The restrained outward movement of each back contact leaf 33 and front contact leaf 34 when the conductor wire 210 is received therebetween generates and maintains an inwardly directed biasing force that provides an enhanced clamping effect against the connector center conductor wire 210, as well as potentially helping seat the center conductor wire within the pin-shaped contactors 35, as shown in FIG. 7. The engagement and support of the front contact leaves 34 of the contacts 28/29 by the inner tube portions 23 of the insulators further helps provide enhanced engagement between the contacts of the center pin and the conductor wire of the cable without requiring thicker, heavier materials to be used for the contact pin. As a result, initial retention force and the retention force of the coupling connector over time and repeated use is increased and maintained at a level exceeding 100 grams of retention force for a 1.0 mm conductive pin of a cable. Testing has further shown that retention forces of greater than 100 grams also have been maintained over multiple feature cycles where the cable pin is inserted and removed multiple times. The female connector outer threads 11 also can screw into locking engagement with the interiorly formed threads 223 of the male connector cap 221 and hex nut 222 to keep the female coupling connector 1 and the male connector 201 rigidly coupled.

Figure 8:
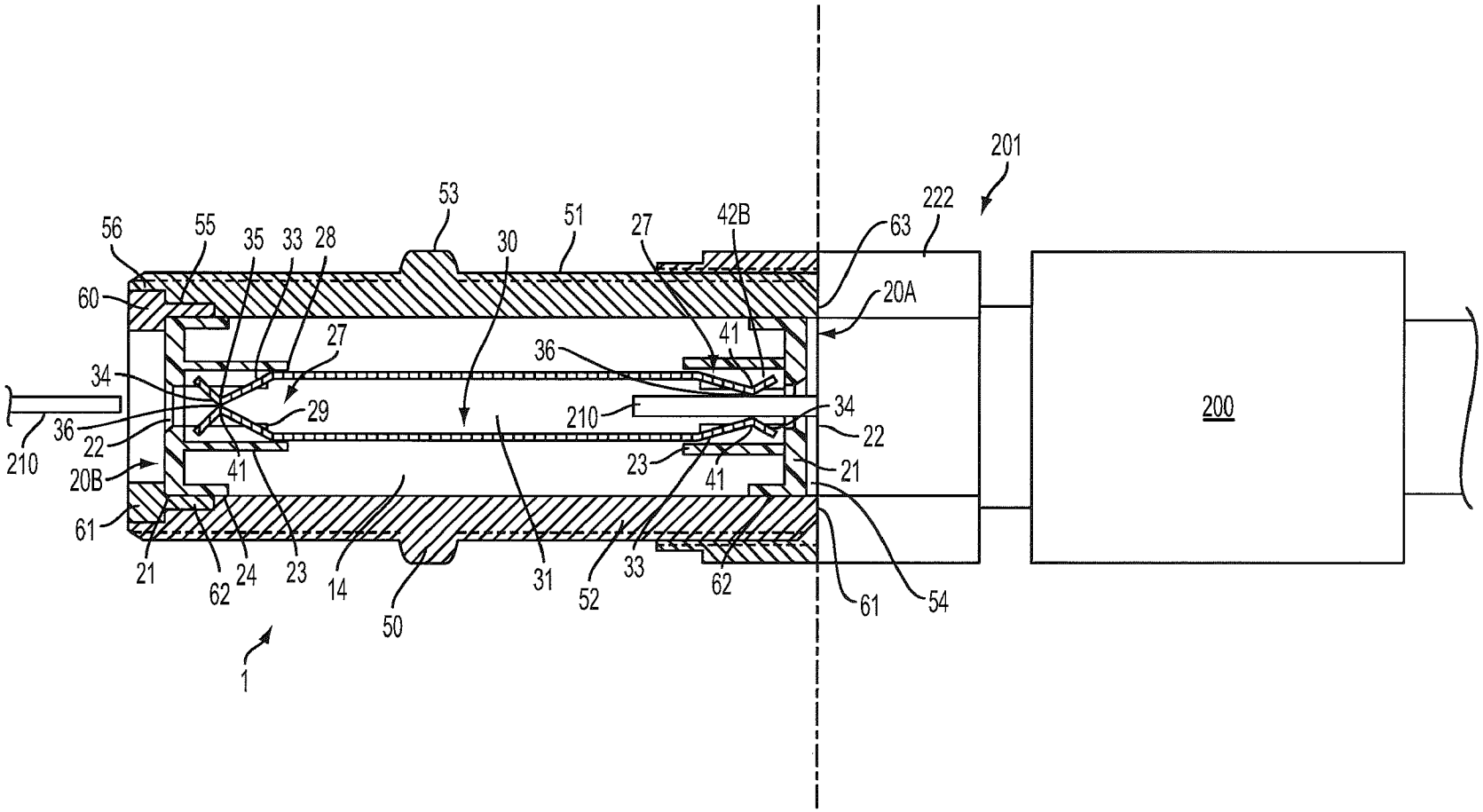
FIG. 8 is a side elevational view, taken in partial cross-section, of an additional embodiment of the coupling connector connected to a cable or transmission line.

FIG. 8 presents another embodiment of a conductor body 50 for the coupling connected according to the principles of the present invention, including a conductive end seal component 60. The conductor body 50 can be constructed with threads along its outside body wall 51, a tubular body 52 having open ends 53A/53B, and generally can have a hex nut 54 in the middle or near to the middle of the tubular body 52, at least one end block 56, and an inner groove 57 and an outer groove 58 at one end of the connector body. The end seal component 60 will be placed adjacent one end of the body and can have a conducting ring 61, typically made from a metal such as copper or other electrically conductive material, with a conductive tubular body 62 of a similar conductive material to help improve electrical conductivity and help enhance potential radio frequency return loss of the transmitted signal projecting rearwardly therefrom, and a front face or surface 63 at the open end of the conductor body. After the center pin 30 and insulators 20A/20B are inserted into the conducting body 50, the conductive end seal component 60 can be hard matched, thermal matched, glued or otherwise mounted in the connector body end(s) in order to seal the conducting body 50. Additionally, as FIG. 8 illustrates, the connector 1 can be connected to a male coaxial connector 201, with a threaded portion of the male connector 201 threadably engaging the threads of the conducting body 50 so as to draw the end seal component 60 of connector 1 into engaging contact with the male connector. Thus, the flat front surface 63 of the conductive end seal component 60 at one end of the connector body can be drawn into contact with the flat facing surface of male connector 201, to assist in providing enhanced radio frequency return loss for the connector 1.

Figure 9:
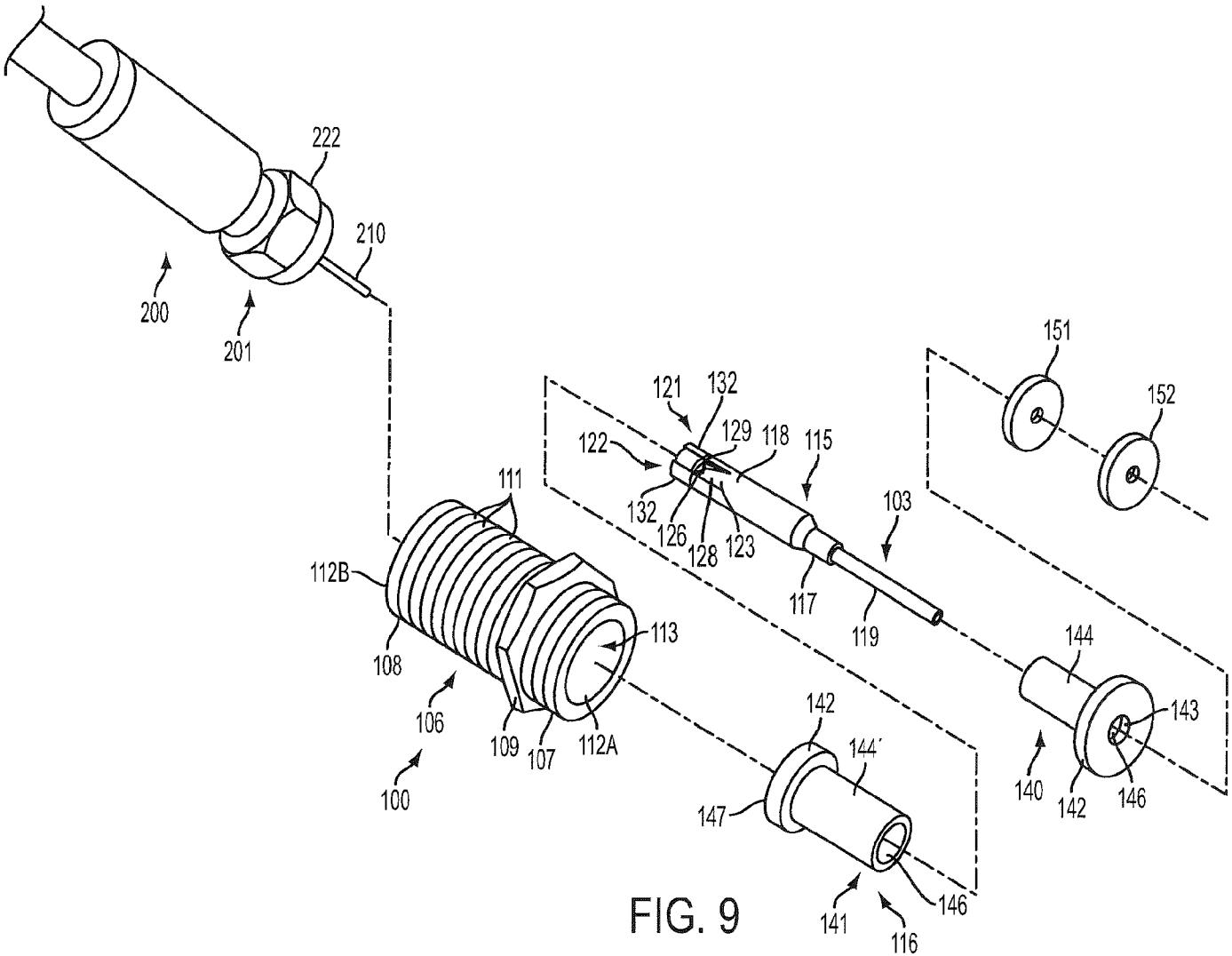
FIG. 9 is an exploded perspective view of an additional embodiment of the coupling connector according to the principles of the present invention.
Figure 10A:
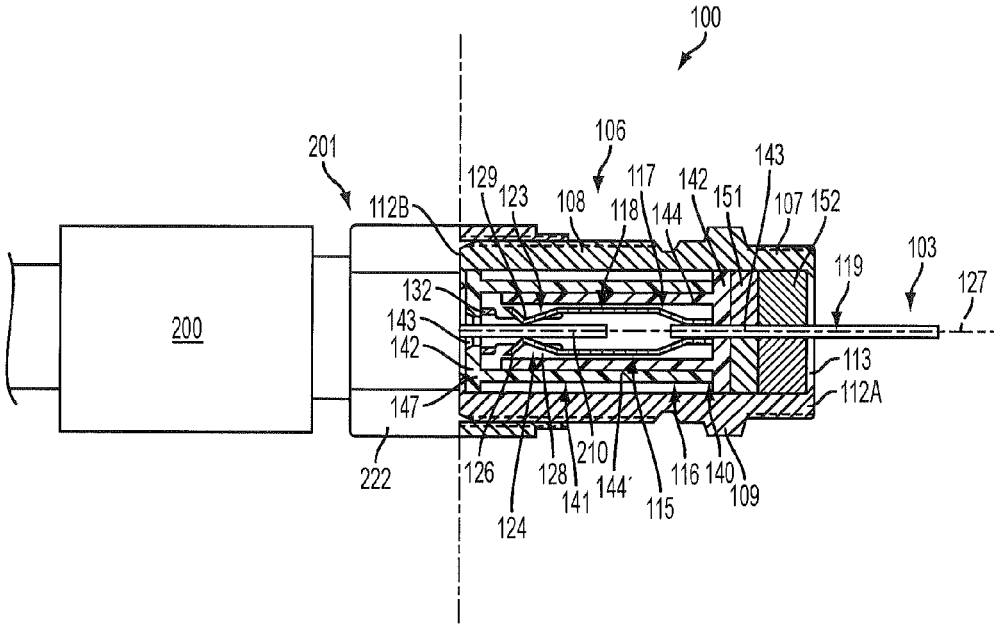
FIG. 10A is a side elevational view, taken in partial cross-section, of the connector body and pin support structure of the embodiment of the coupling connector of FIG. 9.
Figure 10B:
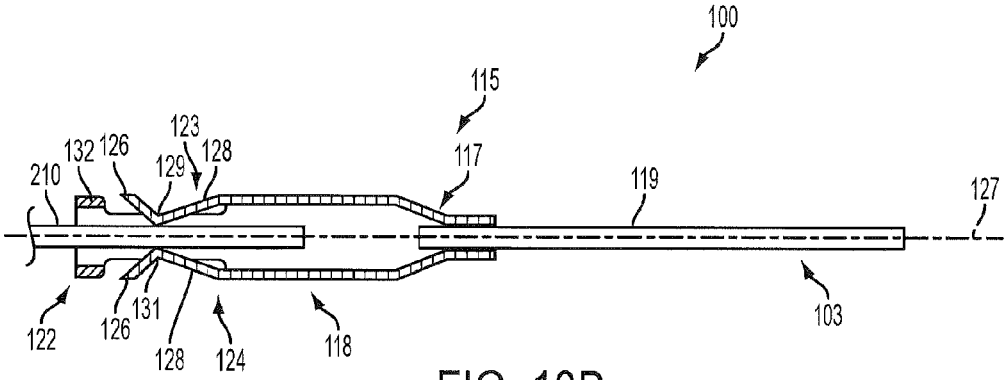
FIG. 10B is a side elevational view, taken in cross-section, of the conductive center pin of the connector of FIG. 9.

FIGS. 9-10B illustrate another embodiment of a coupling connector 100 such as for coupling a coaxial cable or other transmission line or wire 200 to a receiver, printed circuit board, or other electrical component (not shown). In this embodiment, the connector 100 receives the center conductive pin or wire 210 of the cable 200 within one end thereof, and further includes a conductive pin 103 that projects from an opposite end. The coupling connector 100 generally includes a substantially cylindrically shaped body 106 having a first body section 107, a second body section 108 and a hex nut 109 formed therebetween. As indicated in FIG. 9, the second body section 108 generally can be of a greater length than the first section 107 as needed, although the body sections further can be formed with substantially the same length, and each body section further can include helical threads 111 formed thereabout. The body 106 further will be formed from a metal or similar conductive material and will include open first and second ends 112A and 112B, with a passage or inner chamber 113 extending therethrough.

As shown in FIGS. 9 and 10A, a conductive center pin 115 and pin support structure 116 are received within and extend along the inner chamber 113 of the body 106 of the coupling connector 100. The center pin 115 in the present embodiment generally includes an elongated body 117 having a first or rearward section 118, and a second or forward section 119, which is generally formed as or includes the conductive pin 103. The pin body 117 can be formed from a blank that can be stamped and rolled, can be die cut, or otherwise formed, with the body sections 118 and 119 being integrally formed, or, alternatively, being formed as separate pieces that are connected together by soldering, welding, or a mechanical or friction fit type of connection.

A contact structure 121 is shown as being formed at the upstream end 122 of the body section 118. As indicated in FIGS. 10A and 10B, the contact structure 121 generally will have a structure substantially the same as the contact structure as described above with reference to the contact pin 30 shown in FIG. 4, including upper and lower contacts 123 and 124 (FIG. 10B) each including a first or back leaf 126 that extends inwardly at an angle toward a center-line or axis 127 of the center pin 115, a second or front leaf 128 that extends at an angle outwardly and forwardly with respect to the center line 127, and a junction 129 formed between the front and back contact leaves 126 and 128. This junction or joint 129 further typically will include a notch or cutout defining areas of increased contact surface 131 therealong so as to provide increased and tighter contact between the upper and lower contacts 123 and 124 and the conductive wire 210 of the cable, and to assist in the centering and seating of the conductive wire within the contacts of the connector. The contact structure 121 further generally will be bounded or supported on the sides thereof by lateral side walls or portions 132 (FIG. 9) of the pin body, as discussed above with regard to the prior embodiment. The side wall portions 132 also can be inherently biased inwardly toward the contacts of the contact structure so as to help support and maintain resilience of the contacts to provide enhanced retention force and a better return loss over time and repeated uses.

In the present embodiment of the coupling connector 100, as illustrated in FIGS. 9 and 10A, the pin support structure 116 generally includes a pair of insulators, including a first insulator 140 and a second insulator 141 adapted to receive at least a portion of the first insulator 140 therein. Each of the insulators 140 and 141 typically is made from a substantially rigid plastic, dielectric or other insulative or non-conducting material, and generally includes a front portion 142 having an expanded diameter and defining a central opening or hole 143 therein, which central opening or hole 143 is adapted to receive the conductive wire 210 of the cable 200 or the conductive pin 103 and center pin assembly 115 therethrough. An inner tube or sleeve 144/144' projects inwardly or rearwardly from each front portion 142 of each of the insulators 140/141, defining a passage or chamber 146 therein. The diameter of the passage 146 of the inner tube 144 of the first insulator 140 generally has a first diameter, while the passage 146 of the inner tube 144 of the second insulator 141 has a second diameter that generally is larger than the first diameter of the inner tube 144 of the first insulator. This second diameter is sufficient to enable the tube 144 of the upstream or first insulator to be received in a sliding fit or engagement within the passage 144 of the tube of the second insulator 141.

During assembly of the connector 100 as indicated in FIG. 9, the conductive center pin 115 will be inserted into the tube 144 of the first insulator 140 of the pin support structure 116, with the conductive pin 103 thereof extending through the center hole or opening 143 so as to project outwardly from the opening 143 of the insulator 140 and from the first or upstream end 112A of the connector body. The center pin is inserted fully into the tube 144 of the first insulator 140 such that the rearward body section 118 of the center pin also is substantially received within the tube 144 of the first insulator. With the center pin substantially received within the tube of the first insulator 140, the rear or upstream end 122 of the center pin, and the inner tube 144 of the first insulator 140 are received within the passage 146 of the inner tube 144' of the second or upstream insulator 141 to form a compact, telescoped support structure 116 as indicated in FIG. 10A. The pin support structure 116 will then be placed within the inner passage or chamber 113 of the connector 100, with the downstream face 147 of the second insulator 141 engaging and bearing against an inner wall portion of the second end 112B of the connector body.

As further indicated in FIGS. 9 and 10A, after the pin and its pin support structure have been inserted into the inner chamber 113 of the connector body, a ring seal such as an O-ring or similar sealing member 151 can be placed over the conductive pin 103 and in front of the front face 147 of the first insulator 140. The sealing ring 151 generally will be of a diameter sufficient to engage the side walls of the inner chamber of the connector body and form a substantially tight, moisture-resistant seal. One or more washers 152, typically formed from a plastic or similar material, additionally can be provided, being fitted over the conductive pin 103 of the center pin structure 115, and likewise engaging the inner side wall of the first insulators to assist in maintaining and enhancing the retention force provided by the present connector construction.

The engagement of the contact structure and the front contact leaves 126 of the upper and lower contacts 123/124 by the inner tube 144 of the insulator 140 helps to provide enhanced engagement between the contacts in the center pin and the conductive wire 210 of the cable 200 by substantially encapsulating and supporting the contacts, and by retaining the front contact leaves in a position such that they tend to apply a downwardly biased force against the conductive pin 210 of the cable. The engagement of the contact structure by the tube 144 further helps prevent the contacts from being deformed or otherwise bent out of their biased engaging positions, while the telescoping of the tube 144 of insulator 140 within the tube 144' of insulator 141 provides further support of the tube 144 and contact structure as well as helping to locate the center pin in a centered position or alignment within the connector body. This telescoped support structure also enables thinner tubes to be used, reducing the costs while providing enhanced support to the center pin and contact structure thereof.

In addition, with the pin support structure 19 (FIG. 3) or 116 (FIG. 9) of the present invention, the center pin 115 (FIG. 9) or 30 (FIGS. 3-4) can be formed with a significantly smaller or reduced diameter or cross-sectional area. For example, the pin connector can be formed with a diameter of less than 5.0 mm and, in one example preferred embodiment, can have a diameter of approximately 2.0-2.5 mm or less. By reducing the size of the center pin down to approximately 2.0-2.5 mm or less, the present invention is able to maintain a maximum resistance of approximately 75 ohms versus larger diameter prior art connector pins that are of an increased size in order to maintain resilience but which can lead to degrade return losses. For example, in return loss testing on connectors formed in accordance with the principles of the present invention, the return loss for such a connector is around 20 dB, which is much better than conventional 10 dB level. Still further, even after a test of 200 insertion/removal cycles, the return loss of the connector according to the principles of the present invention was found to be maintained around 20 dB, with essentially no significant degradation or increase in return loss, which well exceeds a conventional 25 cycle test standard.

As a result, the natural resilience of the contacts is substantially maintained even over repeated uses such that the initial retention force and retention force of the coupling connector over time and repeated uses is increased and maintained at a level exceeding a minimum of 100 grams and up to approximately 300 grams of retention force, even with cable pins as small as 1.0-1.05 mm in diameter. Further testing has shown the structure of the present connector to retain its retention force of at least 100 grams up to 300 grams even after as many as 200-300 use cycles wherein the cable pin is removed and reinserted 200-300 times. In addition, in testing as to insertion loss, connectors constructed in accordance with the structure of the present invention were shown to have an insertion loss of about 0.1 dB at 2150 MHz. This insertion loss further was found to be essentially maintained with minimal or no degradation after repeated use cycle testing of up to 200 insertion/removal cycles.

Accordingly, the coupling connector of the present invention is able to utilize smaller diameter center connector pins with a resultant improvement in return loss and resistance so as to minimize signal loss over time and without further resulting in a loss of retention force over repeated use cycles and over time as the connector is subjected to humidity, temperature fluctuations, etc. The structure of the coupling connector formed in accordance with the principles of the present invention therefore provides a stable, high-quality connection between a coaxial or data transmission cable or wire and a receiver that is able to handle higher frequencies and bandwidths without significantly increasing signal loss and without requiring the use of thicker and more costly alloys or conductive materials that would correspondingly increase the cost of the connector itself.

Accordingly, it will be understood by those skilled in the art that while the present invention has been disclosed with reference to certain preferred embodiments discussed above, various modifications, changes and variations can be made thereto without departing from the spirit and scope of the present invention as set forth in the following claims.

The invention claimed is:

1. A connector for a coaxial cable, comprising:

a connector body having first and second ends and defining an inner chamber between said first and second ends;

a center pin received within said inner chamber and formed from a conductive material, said center pin including at least one contact structure at one end of said center pin, said contact structure comprising at least one pair of lipped contacts biased toward each other for engaging a conductor wire of the coaxial cable and each comprising upper and lower contact leaves each having a first portion extending inwardly toward each other and a second portion extending outwardly, said upper and lower contact leaves adapted to receive the conductor wire of the coaxial cable therebetween; and a pin support structure, including a first insulator adapted to receive an end of said center pin opposite said contact structure therein and a second insulator adapted to fit about and support said contact structure of said center pin, each of said insulators formed from a dielectric material and;

wherein said center pin comprises a cylindrical pin body having a diameter sufficient to receive the conductor wire of the coaxial cable therein with the conductor wire engaged between said lipped contacts of said at least one contact structure, and wherein said first and second insulators substantially encapsulate said ends of said center pin and said at least one contact structure with said second portion being substantially engaged therewithin such that said upper and lower contact leaves are maintained in a position biased toward one another so as to maintain resilience and engagement of said contacts contact leaves with the conductor wire of the coaxial cable over repeated uses and time.

2. The connector of claim 1, wherein said each of said upper and lower contact leaves further comprises a notch formed at an intersection between said first and second portions thereof, each notch defining a pin-shaped contactor.

3. The connector of claim 1, wherein said center pin comprises an elongated pin at said end opposite from said contact structure.

4. The connector of claim 3 and further comprising a sealing member received about said elongated pin to provide resistance to moisture entering said connector body.

5. The connector of claim 1 and further comprising at least one washer between at last one of said first and second insulators of said pin support structure and at least one end of said connector body.

6. The connector of claim 1, wherein said center pin comprises a diameter of less than approximately 2.5 mm.

7. The connector of claim 1, wherein said first and second insulators each comprise a front part having a hole defined approximately in the center thereof and which generally aligns with said center pin, and an elongated tube portion within which said ends of said center pin are received and substantially enclosed.

8. The conductor of claim 7, wherein said tube portion of said first insulator has a first diameter, said tube portion of said second insulator has a second diameter larger than said first diameter such that said tube portion of said second insulator is adapted to receive said tube of said first insulator therein in a telescoped relationship.

9. A coupling connector for a cable, comprising:

a body defining an inner chamber;

a center pin formed from a conductive material, the center pin comprising an elongated body received within the inner chamber of the body and having at least one contact structure formed at one end thereof;

wherein the at least one contact structure comprises upper and lower contacts, each including an inwardly directed back contact leaf and an outwardly directed front contact leaf with a junction formed between the front contact leaf and the back contact leaf of the upper and lower contacts and defining a pin-shaped contact having an increased contact surface area, the upper and lower contacts engaging a conductive pin of the cable in a biased engagement along the pin-shaped contact area; and a pin support structure including a first insulator having a tube portion adapted to receive an end of the center pin opposite the contact structure, and a second insulator having a tube portion adapted to receive the contact structure therein, with the front contact leaves of the upper and lower contacts substantially encapsulated within and engaging a side wall of the tube portion and being supported and maintained in an inwardly biased alignment so as to provide enhanced retention force to the contacts in engagement with the conductive pin of the cable and maintain such retention force over repeated uses of the coupling connector.

10. The coupling connector of claim 9, wherein the center pin comprises a diameter of approximately 2.5 mm or less.

11. The coupling connector of claim 9, wherein the tube portion of the first insulator has a first diameter, and the tube portion of the second insulator has a second diameter larger than the first diameter such that the tube portion of the second sleeve is adapted to receive the tube of the first sleeve therein in a telescoped relationship.

12. The coupling connector of claim 9, wherein the center pin comprises an elongated pin at the end opposite from said contact structure.

13. The coupling connector of claim 9, further comprising a sealing member received about the elongated body of the center pin to provide resistance to moisture entering the body of the coupling connector.

* * * * *